US005592742A

United States Patent [19]

Okamura

[11] Patent Number: 5,592,742

[45] Date of Patent: Jan. 14, 1997

[54] CUTTING EDGE ARRANGEMENT

[76] Inventor: Toshio Okamura, 12, Yasui-cho 4-chome, Nishinomiya-shi Hyogo-ken, Japan

[21] Appl. No.: 402,508

[22] Filed: Mar. 13, 1995

[51] Int. Cl.[6] ..... B26B 5/00

[52] U.S. Cl. ..... 30/254; 30/260; 30/305; 30/314; 30/349; 30/353

[58] Field of Search ..... 30/349, 353, 254, 30/501, 502, 503, 503.5, 346.57, 346, 348, 357, 299, 304, 305, 314, 260

[56] References Cited

U.S. PATENT DOCUMENTS 3,262,206 7/1966 Tomek ..... 30/346
3,842,502 10/1974 Hagan ..... 30/346.57
3,895,442 7/1975 Langford ..... 30/299
4,193,189 3/1980 Marin ..... 30/349

FOREIGN PATENT DOCUMENTS 0857767 7/1949 Germany ..... 30/349

*Primary Examiner*—Rinaldi I. Rada
*Assistant Examiner*—Allan M. Schrock
*Attorney, Agent, or Firm*—Evenson, McKeown, Edwards & Lenahan, P.L.L.C.

[57] ABSTRACT

A cutting edge arrangement comprising multiple cutting plates, each plate having opposing planar surfaces and a cutting edge along one side, said plates joined together along facing planar surfaces, the cutting edges aligned parallel to each other and slightly offset in a direction perpendicular to the cutting edges, wherein said plates may be removed one by one to maintain a sharp cutting edge.

17 Claims, 7 Drawing Sheets

CUTTING EDGE ARRANGEMENT

BACKGROUND AND SUMMARY OF THE INVENTION

This invention relates to a cutting edge arrangement comprising multiple plates, each plate having a cutting edge along one side, the plates joined together with the cutting edges aligned parallel to each other and slightly offset in a direction perpendicular to the cutting edges so that only one cutting plate forms the outermost edge, wherein said plates may be removed one by one to maintain a sharp cutting edge.

There are many known tools which have cutting edges, such as knives, razors, scissors, and various cutting blades. These conventional edged tools have to be sharpened in order to maintain a sharp cutting edge. Sharpening can be an inconvenient process, such as when a sharpener is not readily available. Sharpening may also be a difficult or impossible process, in the case of very hard materials, such as stainless steel.

The object of this invention is to provide a cutting edge arrangement that does not require sharpening in order to maintain a sharp edge.

This object has been achieved according to the present invention by providing a cutting edge arrangement comprising multiple cutting plates, each cutting plate having two opposing planar surfaces and having a cutting edge along an edge. The cutting plates are bonded together along facing planar surfaces with the cutting edges aligned parallel to each other and slightly offset in a direction perpendicular to the cutting edges. When the outermost edge of the cutting edge arrangement becomes dull, the cutting plate having that dull cutting edge may be removed so that the next cutting plate, having a sharp cutting edge, becomes the new outermost edge of the cutting edge arrangement. As each succeeding outermost edge of the cutting edge arrangement becomes dull, the cutting plate corresponding to that dull cutting edge is removed. In this way, a sharp cutting edge is maintained without sharpening. Any number of cutting plates may be used, the number of cutting plates determining the useful life of the cutting edge arrangement.

There are various methods which may be used to construct the cutting edge arrangements. In a first method, each cutting plate with a cutting edge is formed separately, and then the cutting plates are bonded together with the cutting edges parallel and slightly offset in a direction generally perpendicular to the cutting edges. Alternatively, the cutting plates may be bonded together first, and then the cutting edges may be formed at the edge of each plate. Yet another method of construction is to first bond together large plates, then form the cutting plates out of bonded plates. In this method, the cutting edges may either be formed at the time the plates are formed, or in a separate step afterwards.

In one preferred embodiment of the present invention in the form of a knife, a base plate is formed preferably of steel or stainless steel preferably having a thickness of 1.5 to 2.0 millimeters. The base plate is connected at one end to a handle. Ten to twenty cutting plates preferably each having a thickness of 0.15 to 0.20 millimeters and each having a cutting edge are bonded to the base plate. The cutting edge of each succeeding cutting plate extends slightly, preferably within the range of 0.2 to 1.5 millimeters, beyond the cutting edge of the previous plate to which it is bonded in a direction generally perpendicular to the cutting edges. In an especially preferred embodiment of the present invention, the cutting edge of each succeeding cutting plate extends within the range of 0.5 to 1.0 millimeters. The cutting plates are preferably made of steel or stainless steel, but may be made of ceramic material which is reinforced with a very thin metal or fiber sheet. A portion of each cutting plate, proximate the handle, is not bonded to aid in the removal of the cutting plates. An area of the non-bonded portion of each cutting plate, is separated from the next cutting plate to allow the cutting plate to be gripped with a tool to be removed. A non-toxic bonding material is used which preferably can be stripped off along with the cutting plate.

In another embodiment of the present invention in the form of a knife, a base plate is connected at one end to the handle. Cutting plates are attached to the base plate magnetically, by magnetizing successive plates with opposite magnetic poles at the ends. In this embodiment, it is preferable that the cutting plates be coated with oil to prevent corrosion from water or other liquids between the cutting plates. In this embodiment, a stopping portion contains the edges of the cutting plates opposite the cutting edges, which may be connected to or integral with the base plate.

In another embodiment of the present invention in the form of a scissors, two cutting edge arrangements having base plates and laminated bodies are rotatably connected. The laminated bodies comprise multiple cutting plates which have cutting edges on one side. The cutting edge arrangements are rotatably connected by a pin member extending through a hole in a central region of each arrangement, with the cutting edges of the first arrangement facing the cutting edges of the second arrangement. Handles are attached to ends of the base plates opposite the laminated bodies.

The cutting edge arrangement of the present invention may also be used for razors, cutting blades, or any other tool which has a cutting edge.

Other objects, advantages and novel features of the present invention will become apparent from the following detailed description of the invention when considered in conjunction with the accompanying drawings.

DETAILED DESCRIPTION OF THE DRAWINGS

Figure 1:
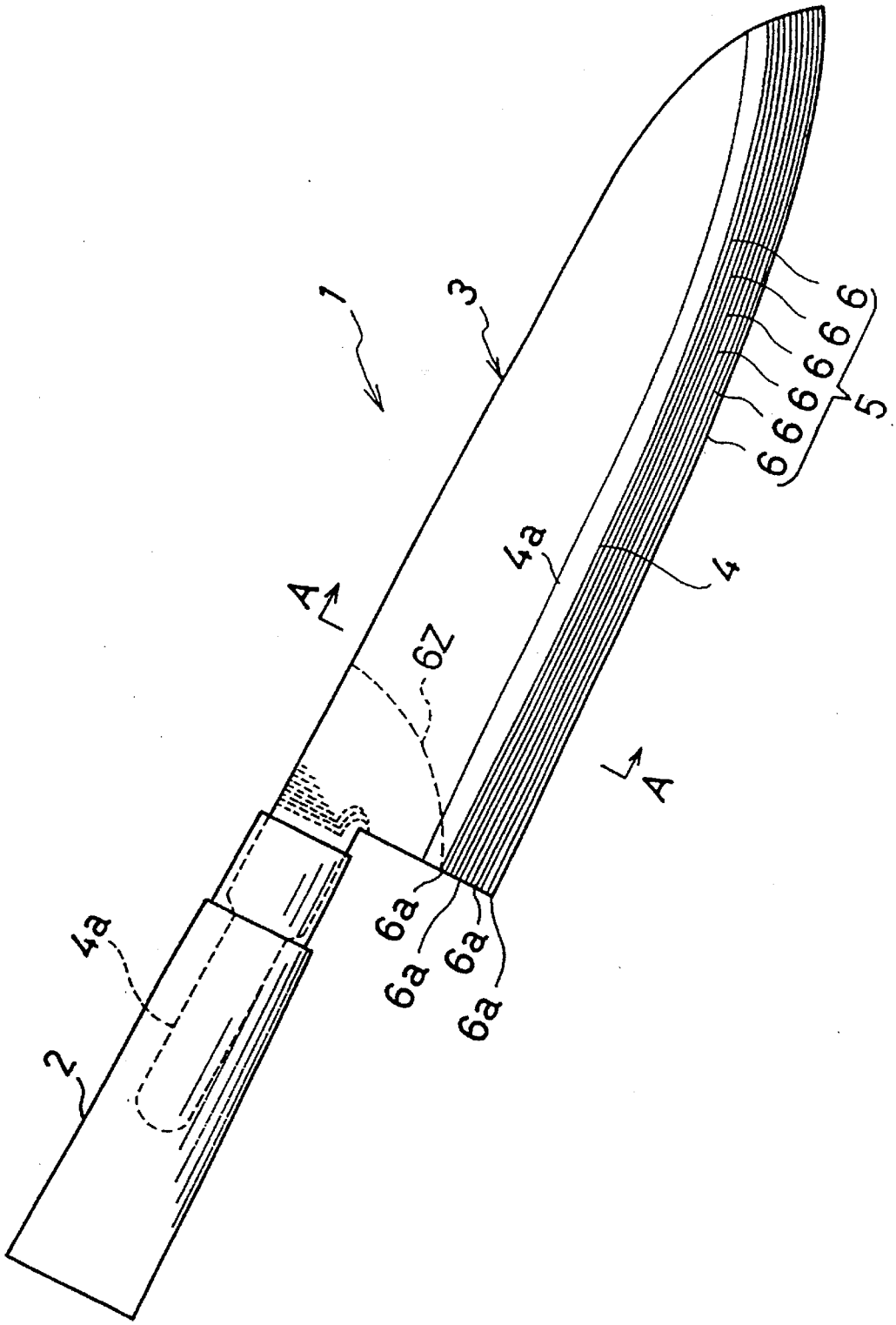
FIG. 1 shows a side view of a cutting edge arrangement in the form of a knife.

In FIG. 1, a cutting edge arrangement 1 in the form of a knife is illustrated having a main body 3 connected to a handle 2 by means of a tang 4*a*. The main body 3 comprises a base plate 4, integral with the tang 4*a* and a laminated body 5 which is bonded to the base plate. The base plate 4 is preferably formed out of steel or stainless steel. The laminated body 5 comprises cutting plates 6 which are bonded to each other on facing surfaces with the cutting edge 6a of each succeeding cutting plate extending slightly, approximately 0.5 to 1.0 millimeters, beyond the cutting edge 6a of the previous cutting plate to which it is bonded in a direction generally perpendicular to the cutting edges. A portion 6Z of each cutting plate 6, proximate the handle 2, is not bonded to the facing cutting plate to aid in the removal of the cutting plates.

Figure 2:
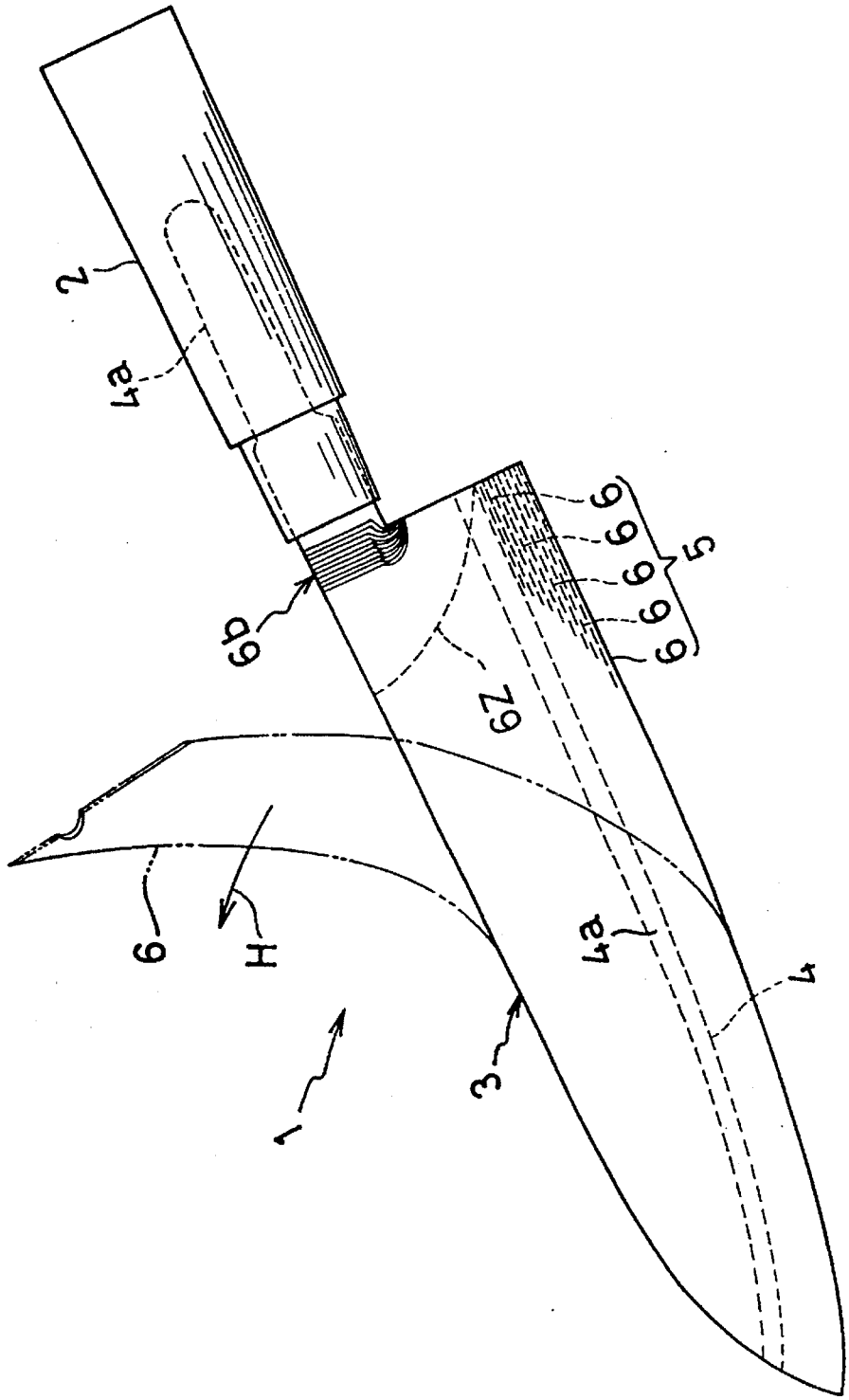
FIG. 2 shows the cutting edge arrangement of FIG. 1 from the opposite side.

FIG. 2 illustrates that in the cutting edge arrangement of FIG. 1, an area 6b of the non-bonded portion 6Z of each cutting plate 6 is separated from the next plate to allow the cutting plate to be gripped with a tool, such as a pliers to be removed from the laminated body 5. FIG. 2 shows in dash-double dot lines a cutting plate 6 being separated from the laminated body 5 by pulling it away in a direction H.

Figure 3:
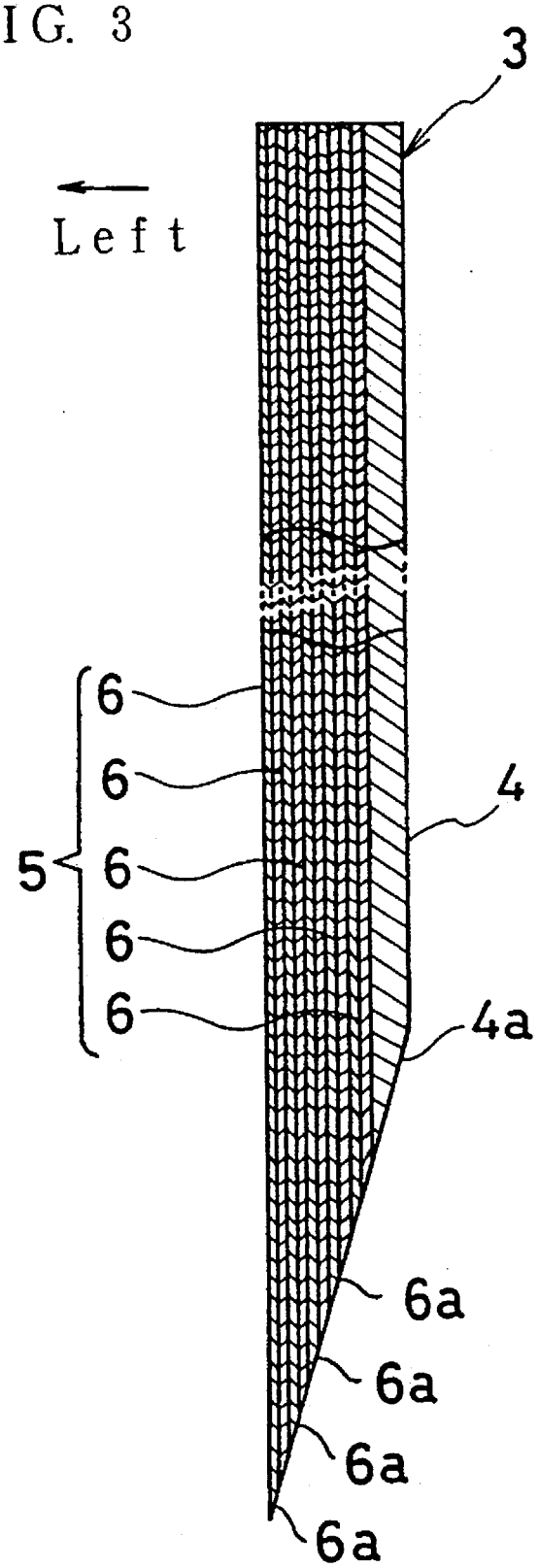
FIG. 3 shows an end view of the cutting edge arrangement of FIG. 1.

FIG. 3 shows an end view of the main body 3 of the cutting edge arrangement of FIG. 1, comprising the base plate 4 and the laminated body 5. The multiple cutting plates 6 are bonded together with cutting edges 6a slightly offset.

Figure 4:
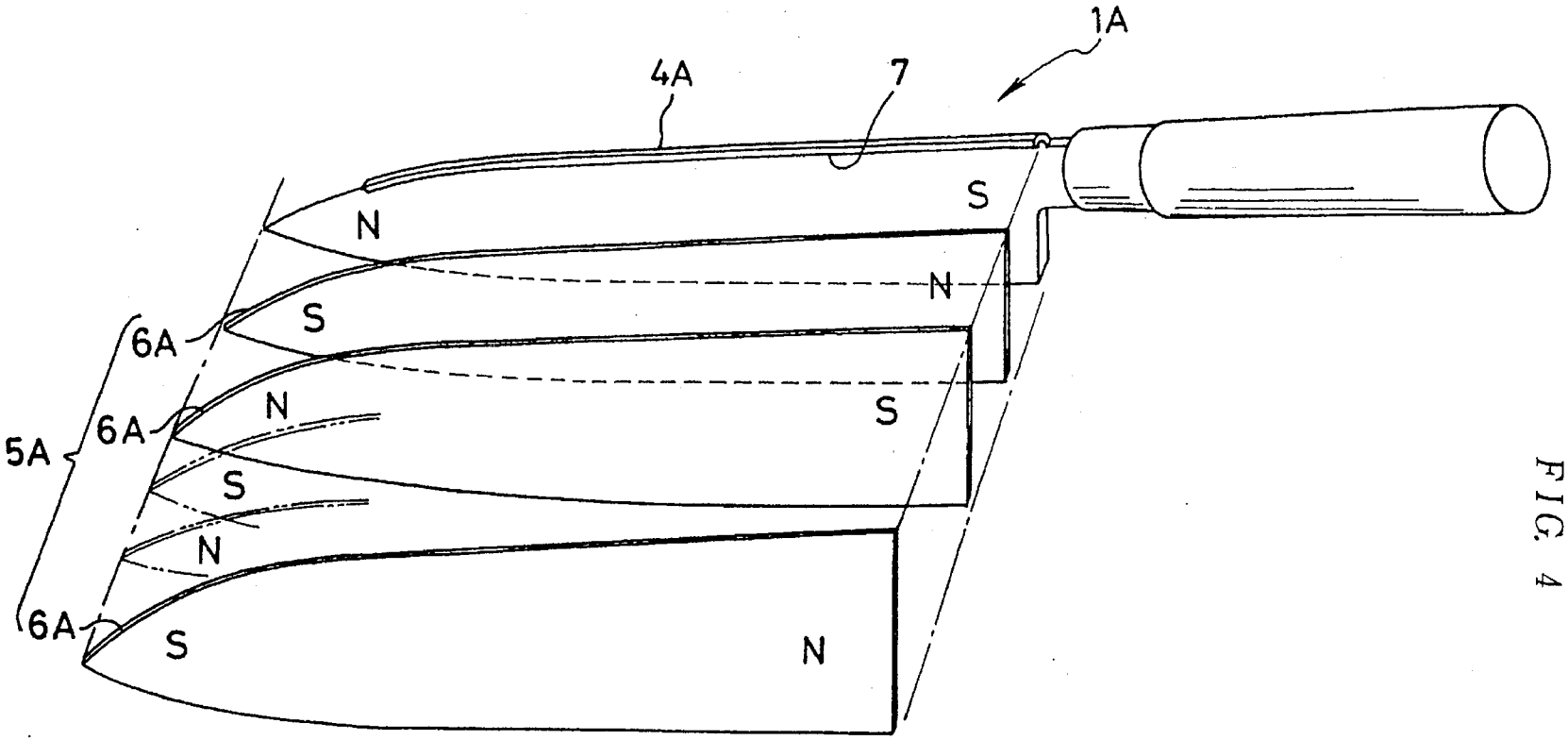
FIG. 4 shows a cutting edge arrangement wherein the cutting blades are joined magnetically.

FIG. 4 shows a cutting edge arrangement in the form of a knife wherein cutting plates 6A are joined together magnetically. Each succeeding cutting plate is magnetically charged with the opposite polar relation of the previous cutting plate, as illustrated by the symbols "N" and "S" which represent the north and south poles of a magnet. The cutting plates 6A are then placed together, with the opposite magnetic poles attracting, thereby holding the blades together. A stopping portion 7 provides additional stability, holding the cutting blades together at an edge opposite the cutting edge.

Figure 5:
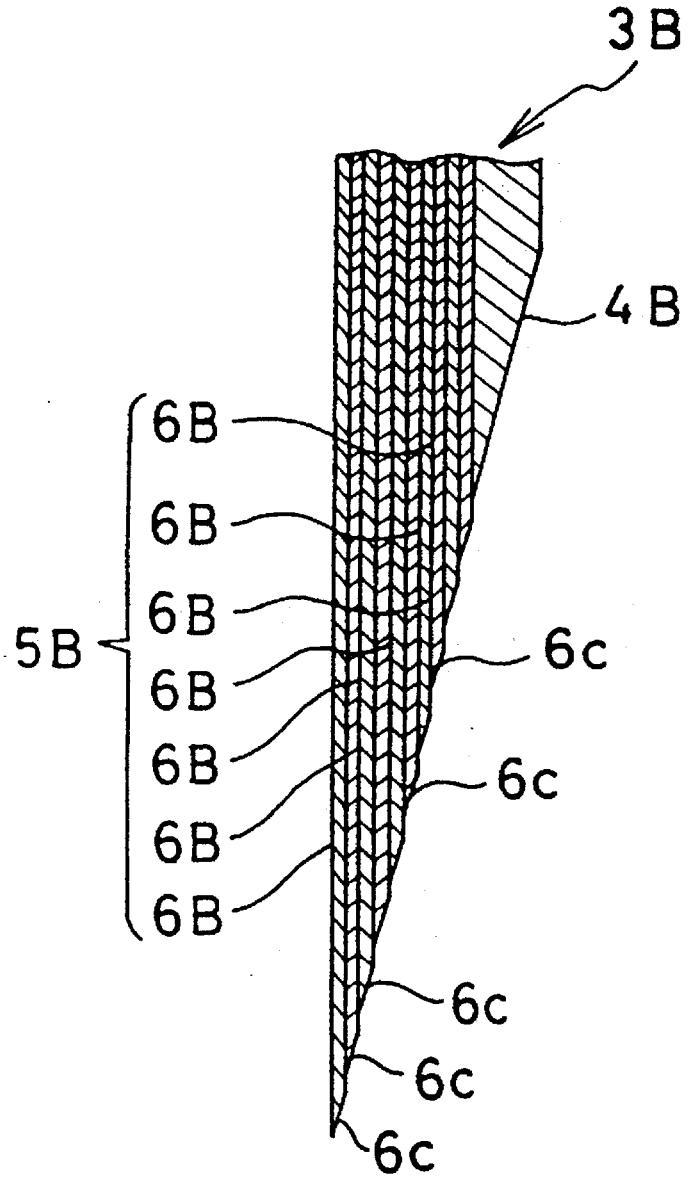
FIG. 5 shows an end view of a cutting edge arrangement.

FIG. 5 shows an end view of a cutting edge arrangement, having a main body 3B, comprising a base plate 4B and a laminated body 5B, where cutting plates 6B are formed first with cutting edges 6c, and then the cutting plates 6B are bonded together with cutting edges 6c slightly offset.

Figure 6:
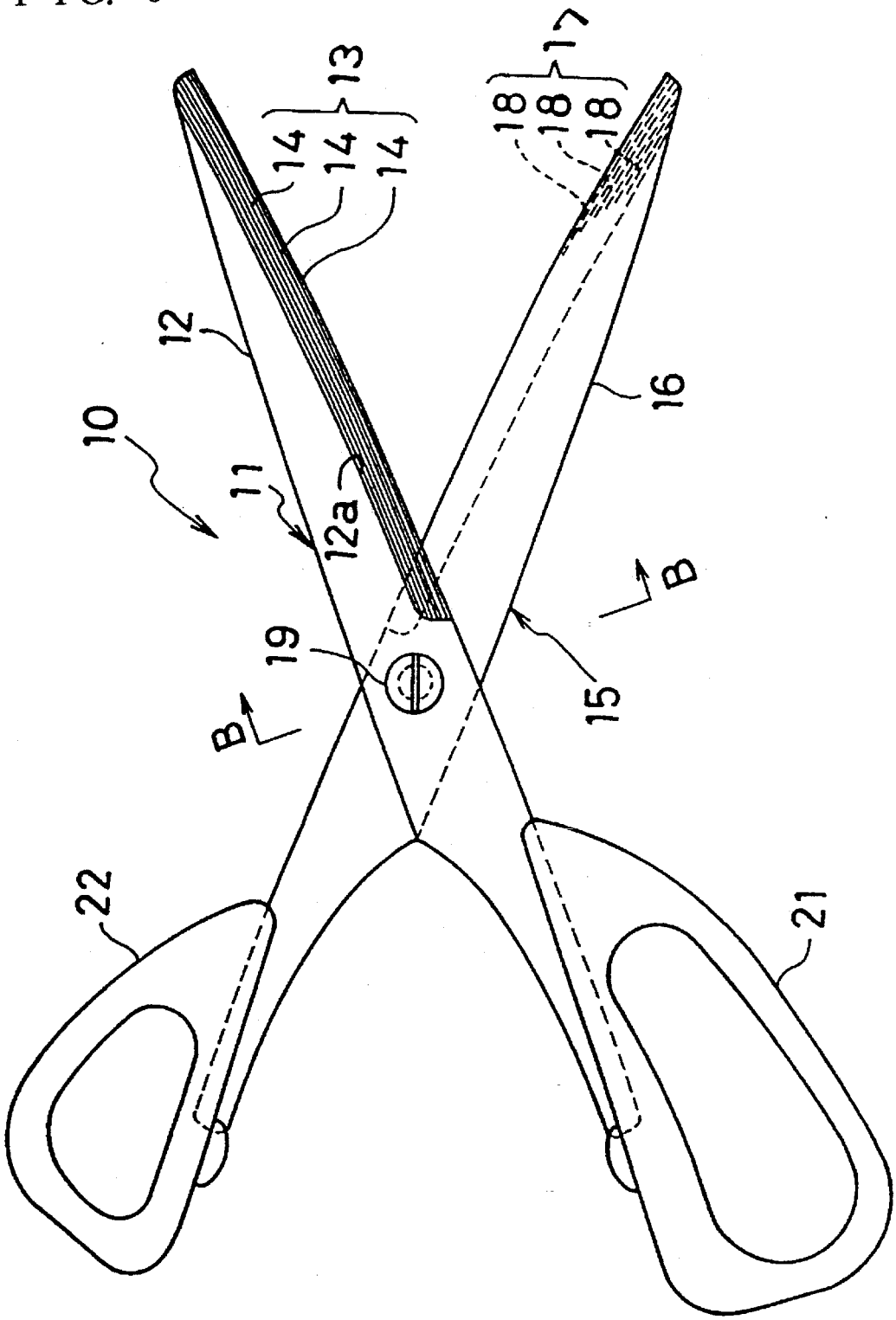
FIG. 6 shows a cutting edge arrangement in the form of a scissors.

In FIG. 6, a cutting edge arrangement 10 in the form of a scissors is shown comprising two cutting edge arrangements 11, 15 comprising base plates 12, 16 and laminated bodies 13, 17 bonded to first ends of the base plates 12, 16 respectively. The laminated bodies 13, 17 comprise multiple cutting plates 14, 18 respectively, which have cutting edges on one side. The cutting edge arrangements 11, 15 are rotatably connected proximate a central region by a pin member 20 extending through a hole 19, with the respective cutting edges facing each other. Handle portions 21, 22 are attached to ends of the base plates opposite the first ends having the laminated bodies.

Figure 7:
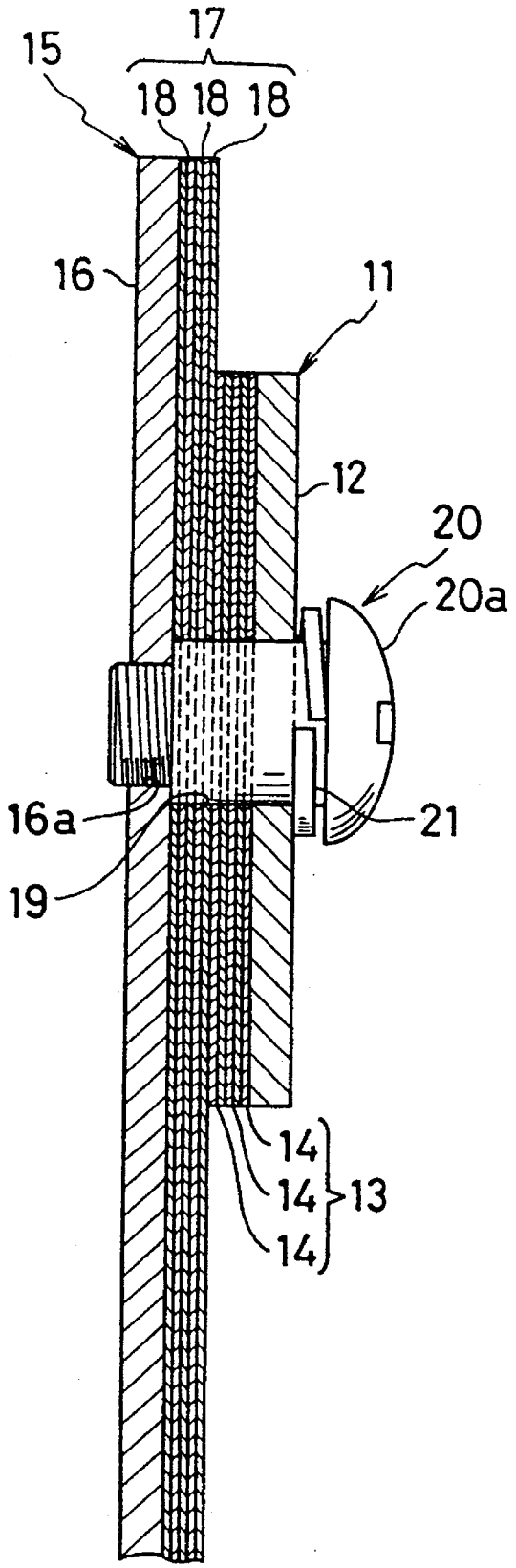
FIG. 7 shows a close-up side view of the cutting edge arrangement of FIG. 6 in the region of a pin member.

In FIG. 7, a close-up side view of the cutting edge arrangement of FIG. 6 in the region of the pin member shows the pin 20 extending through the hole 19 in the cutting edge arrangements 11, 15. The pin 20 comprises a slotted head 20a at one end proximate the base plate 12, and a threaded portion at the opposite end which engages mating threads in the base plate 16. A lock washer 21 is disposed between the slotted head 20a and the base plate 12.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A cutting device having a cutting edge arrangement, comprising:

a base plate, multiple cutting plates attached to said base plate, and a single exposed operative cutting edge, each said cutting plate having opposing flat surfaces and a cutting edge, said cutting plates being removably joined together in series between said base plate and an outermost cutting plate having an outermost cutting edge, said outermost cutting edge comprising said single exposed operative cutting edge, said cutting plates being removably joined together in series along facing said flat surfaces with each successive said cutting edge aligned parallel to and extending slightly beyond the cutting edge of a previous cutting plate in a direction generally perpendicular to the cutting edges, wherein after said outermost cutting edge becomes dull, said outermost cutting plate is removed in order to expose a successive outermost cutting plate with a sharp said outermost cutting edge.

2. The cutting device according to claim 1, wherein said cutting plates are joined together by adhesive bonding.

3. The cutting device according to claim 1, wherein said cutting plates are joined together magnetically.

4. The cutting device according to claim 3, further comprising a stopping portion along an edge of the cutting plates opposite the cutting edge.

5. The cutting device according to claim 1, wherein an unjoined portion of each cutting plate is not joined to the previous cutting plate, and wherein each unjoined portion further comprises an area which is separated from the previous cutting plate to aid in the removal of the cutting plates.

6. The cutting device according to claim 1, wherein the cutting plates are made of stainless steel.

7. The cutting device according to claim 1, wherein the cutting plates are made of ceramic material which is reinforced with very thin metal or fiber sheets.

8. The cutting device according to claim 1, wherein the cutting plates have a thickness within the range of 0.15 to 0.20 millimeters.

9. The cutting device according to claim 1, wherein each successive cutting edge extends beyond the cutting edge of a previous cutting plate within the range of 0.2 to 1.5 millimeters.

10. The cutting device according to claim 1, further comprising a handle connected to the base plate.

11. The cutting device according to claim 1, wherein the cutting device comprises a knife.

12. A cutting device according to claim 1, wherein said outermost cutting plate is removed by a means for removing said cutting plates in order to expose a successive outermost cutting plate with a sharp said outermost cutting edge.

13. A cutting device according to claim 1, wherein said cutting edge of said previous cutting plate abuts with zero clearance the flat surface of an adjacent cutting plate which faces said previous cutting plate.

14. A cutting device according to claim 13, wherein an extreme outermost portion of said cutting edge of said previous cutting plate abuts with zero clearance the flat surface of the adjacent cutting plate which faces said previous cutting plate.

15. A cutting device having a cutting edge arrangement, comprising:

a first base plate, a second base plate, a first set of multiple cutting plates attached to said first base plate to form a first cutting element, and a second set of multiple cutting plates attached to said second base plate to form a second cutting element, the first cutting element being rotatably connected to the second cutting element proximate a central region by a pin member extending through a hole in said first and said cutting elements, each said cutting plate having opposing flat surfaces and a cutting edge, each said set of cutting plates being removably joined together in series between the corresponding said base plate and a respective outermost cutting plate having an outermost cutting edge, said cutting plates being removably joined together in series along facing said flat surfaces with each successive said cutting edge aligned parallel to and extending slightly beyond the cutting edge of a previous cutting plate in a direction generally perpendicular to the cutting edges, wherein after said outermost cutting edge becomes dull, said outermost cutting plate is removed in order to expose a successive outermost cutting plate with a sharp said outermost cutting edge, and wherein said first and said second cutting elements are arranged such that the outermost cutting edge of the first cutting element faces the outermost cutting edge of the second cutting element, and such that the outermost cutting edge of the first cutting element passes the outermost cutting edge of the second cutting element with substantially zero clearance when the cutting elements are rotated about said pin member.

16. The cutting device according to claim 15, wherein handle portions are attached to the base plates.

17. The cutting device according to claim 15, wherein the cutting device comprises a scissors.

* * * * *